United States Patent [19]

Komatsubara et al.

[11] Patent Number: 4,838,958

[45] Date of Patent: Jun. 13, 1989

[54] ALUMINUM-ALLOY ROLLED SHEET AND PRODUCTION METHOD THEREFOR

[75] Inventors: Toshio Komatsubara; Toshiki Muramatsu; Mamoru Matsuo, all of Fukaya, Japan

[73] Assignee: Sky Aluminum Co., Ltd., Tokyo, Japan

[21] Appl. No.: 94,207

[22] Filed: Sep. 8, 1987

[30] Foreign Application Priority Data

Sep. 9, 1986 [JP] Japan ..... 61-212030

[51] Int. Cl.[4] ..... C22F 1/04

[52] U.S. Cl. ..... 148/11.5 A; 148/12.7 A; 148/417; 148/439

[58] Field of Search ..... 148/439, 417, 2, 11.5 A, 148/12.7 A

[56] References Cited

U.S. PATENT DOCUMENTS 4,186,034 1/1970 Akeret ..... 148/11.5 A
4,645,544 2/1987 Baba et al. ..... 148/12.7 A

FOREIGN PATENT DOCUMENTS 53-103914 9/1978 Japan .
55-8499 1/1980 Japan .
57-98648 6/1982 Japan .

*Primary Examiner*—R. Dean
*Attorney, Agent, or Firm*—Armstrong, Nikaido, Marmelstein, Kubovcik & Murray

[57] ABSTRACT

A T4 tempered and straightened rolled sheet of the Al—Mg—Cu series aluminum-alloy which contains from 1.5 to 5.5% of Mg and from 0.18 to 1.5% of Cu as the essential alloying element, has excellent mechanical properties, an improved formability, of a non-generation of Lüder's marks. After the T4 treatment and subsequent straightening, the sheet is subjected to heating to a temperature in the range of from 60° to 360° C., at a heating rate falling within the hatched region of FIG. 1 attached herewith, then holding within the hatched region of FIG. 2 attached herewith, and subsequently, cooling at a cooling rate falling within the hatched region of FIG. 1.

26 Claims, 2 Drawing Sheets

ALUMINUM-ALLOY ROLLED SHEET AND PRODUCTION METHOD THEREFOR

BACKGROUND OF THE INVENTION

1. Field of the Invention

The present invention is related to an Al—Mg series aluminum alloy rolled sheet, which is used for producing formed articles, such as a body sheet, air-cleaner, oil tank, and the like of an automobile, in which a high strength and formability, particularly the elongation, bulging, and bending properties, are required. The present invention is also related to a method for producing the Al—Mg series aluminum alloy rolled sheet.

2. Description of the Related Art

The most frequently used sheets for forming body sheets and the like of an automobile have heretofore been cold-rolled steel. In recent years, however, in order to decrease the weight of an automobile, and thus the fuel consumption thereof, there has been an increasing demand for conventional cold rolled steel sheets to be replaced by aluminum alloy rolled sheets. Accordingly, an aluminum alloy sheet 5052 alloy of the Al—Mg series with 0 temper, 2036 alloy of the Al-Cu series with T4 temper, and 6009 and 6010 alloys of the Al—Mg—Si series with T4 temper have been employed for the above applications.

The 5182 alloy with 0 temper exhibits excellent formability but Lüder's marks occur in the forming. It also exhibits a noticeable softening at the baking after forming.

The stretcher strain free (SSF) 5182 alloy does not show Lüder's marks but exhibits poor formability.

The 2036 alloy with T4 temper exhibits poor corrosion resistance and softens after baking. In addition, its formability deteriorates due to secular changes.

The 6010 and 6009 alloys with T4 temper exhibit somewhat poor corrosion resistance. In addition, its formability deteriorates due to the secular change.

Al—Mg—Zn—Cu alloy exhibits an excellent formability, but the strength-reduction due to baking is great and the formability deteriorates due to the secular change.

None of the previously known alloys satisfy all of the requirements of good formability, freedom from secular changes, nonformation of Lüder's marks, a small strength decrease after baking or forming, and good corrosion resistance.

SUMMARY OF THE INVENTION

Accordingly, an object of the present invention is to provide an aluminum alloy rolled sheet having a satisfactory strength when used as a body sheet of an automobile and free from Lüder's marks during the formation thereof.

It is a specific object of the present invention to provide a heat treatable aluminum alloy rolled sheet which exhibits a strength comparable to that of a cold rolled steel sheet, and which exhibits an excellent formability, particularly the bending and bulging properties, comparable to that of the 5052 and 5182 alloys with 0 temper.

A further object of the present invention is to provide a process for the production of the aluminum alloy rolled sheet as described above.

In accordance with the objects of present invention there is provided a heat-treated, aluminum alloy rolled sheet for forming, which does not exhibit Lüder's marks, and which consists, by percentage weight, of from 1.5 to 5.5% of Mg, from 0.18 to 1.5% of Cu, and, if necessary, at least one element selected from the group consisting of from 0.05 to 0.6% of Mn, from 0.05 to 0.3% of Zr, and 0.05 to 0.3% of Cr, the balance being aluminum and unavoidable impurities including from 0.05 to 0.4% of Fe and 0.05 to 0.4% of Si.

In this alloy, Cu and one or more of Mn, Zr and Cr are added to the Al—Mg series alloy. The alloy is subjected to forming under heat treated conditions and exhibits the properties of freedom from Lüder's marks and an improved strength and formability.

The heat treated aluminum alloy rolled sheet mentioned above can be produced according to the present invention by a process comprising the steps of: homogenizing an ingot having the composition mentioned above at a temperature of from 450° to 560° C.; rolling until required thickness is realized; and subsequently solid solution treating at a temperature of from 350° to 560° C., preferably from 460° to 560° C., followed by rapid cooling at a cooling rate of 300° C./min or more, preferably 1000° C./min or more.

The solid solution treatment and quenching imparts a T4 temper to a rolled sheet of the Al—Mg—Cu series aluminum alloy. When a rolled sheet in the form of a large-sized cut sheet or a coil is subjected to this treatment, for solid-solutioning and quenching, the sheet is deformed due to thermal expansion and shrinkage, thereby generating "warp", "wave", "twist", and the like (these deformations are hereinafter referred to as distortion), and seriously degrading the flatness of a sheet.

The sheet to be subjected to forming must have a good flatness. Therefore, a rolled sheet should not be subjected to forming while it is under distortion, which is generated due to rapid heating and quenching. Furthermore, the generation of distortion should be avoided at all costs from the viewpoint of appearance and to prevent flaw generations during forming operations, packaging, and handling. From these viewpoints, it is necessary in the production of a rolled sheet of an Al—Mg—Cu series aluminum alloy that, subsequent to the solid solutioning and quenching steps, an additional step for straightening the distortion and improving the flatness is carried out. The usual methods for straightening the distortion are skin pass rolling with a light reduction rate, levelling with bending and unbending by passing through the straightening rolls, if necessary, further together with applying tension to a rolled sheet, and stretching to impart a low tensional deformation.

A rolled sheet is cold worked in the straightening, with the result that the excellent formability provided by the recrystallization, solid solutioning, and quenching treatments is reduced. Therefore, a desired formability, particularly the bulging property, may not be exhibited in this case.

It is therefore another object of the present invention to relieve the work hardening induced in the straightening step by a final heat treatment, to restore the formability, particularly the bulging property, reduced by the straightening, to the improved formability attained by the T4 tempering.

Specifically, the present invention provides a method for producing an Al—Mg—Cu series aluminum alloy rolled sheet, wherein, subsequent to the straightening step, the rolled sheet is subjected to a heat treatment, wherein heating to a temperature of from 60° to 360° C. is carried out at a speed falling within the hatched region in the appended FIG. 1, the temperature is held for a time falling within the hatched region in the appended FIG. 2, and then cooling is carried out at a speed falling within the hatched region of FIG. 1.

A process for producing a formed product of an aluminum alloy, according to the present invention is characterized by:

forming the sheet into a structural member by such a working degree that Lüder's marks are formed in the case of a composition of the aluminum alloy without Cu addition, thereby obtaining a structural member without Lüder's marks;

applying paint on a formed body; and baking the paint while the decrease in yield strength is small.

DESCRIPTION OF THE PREFERRED EMBODIMENTS

Figure 1:
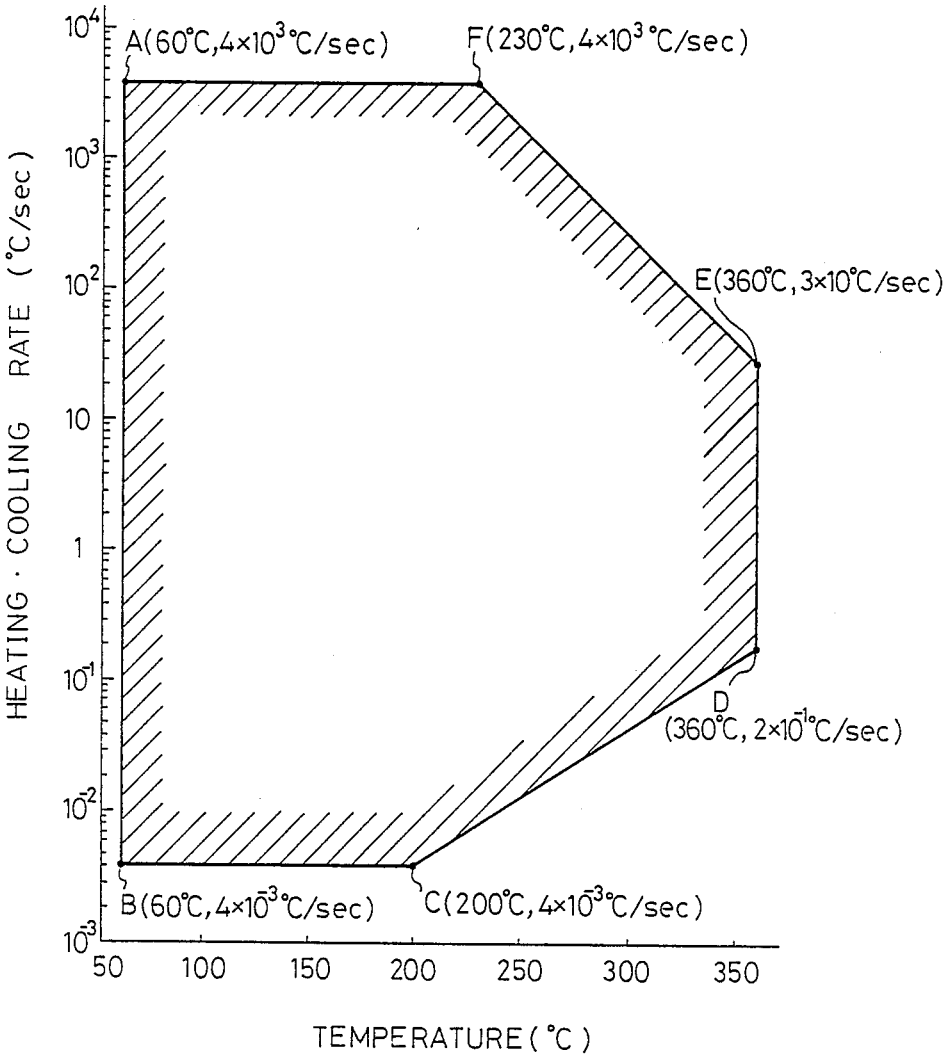
FIG. 1 is a graph showing appropriate ranges of heating and cooling rates in connection with the temperature of a final heat treatment.

First, the composition of the heat-treated aluminum alloy rolled sheet according to the present invention is described.

Mg: Mg is the fundamental alloy element of the series of aluminum alloys to which the present invention belongs and contributes to the enhancement of strength and formability, particularly the elongation and bulging properties, at a content of at least 1.5%. When the Mg content exceeds 5.5%, the elongation property and the rollability are impaired.

Cu: Cu is a characterizing element in the present invention, since it effectively enhances the strength and bending property and prevents the generation of Lüder's marks at a Cu content of at least 0.18%. The strength enhanced by Cu does not lower but rather further increases by the baking of a paint applied on the blank sheet. The strength reduction at the baking of a paint after forming of the blank sheet is only slight.

When the Cu content exceeds 1.5%, the formability is impaired.

Mn, Zr, Cr: Mn, Zr and Cr effectively refine the recrystallized grains and unifies the structure. These effects are not attained at the content of Mn, Zr and/or Cr of 0.05% or less. On the other hand, when the Mn content exceed 0.6% and the formability is impaired. When the Zr and Cr contents exceed 0.3%, coarse intermetallic compounds are formed.

Fe, Si: In addition to the above elements, Fe and Si are contained as unavoidable impurities in ordinary aluminum alloys. Although neither Fe nor Si are important elements in the present invention, they may be contained in an amount of 0.4% at highest. A content higher than that will give an amount of crystallites that will be too large to maintain an improved formability.

It is uneconomical to purify the alloy to an extent of less than 0.05% of Fe and less than 0.05% of Si.

Further, the above elements Ti or Ti and B may be added to refine the crystal grains of a cast ingot, but preferably, the Ti content should be 0.15% or less, to prevent the formation of coarse $TiAl_3$ intermetallics during the solidification, and further preferably, the B content should be 0.01% or less to prevent the formation of $TiB_2$ particles.

Be: Be is usually contained in Al alloys containing 2% or more of Mg to prevent the oxidation of Mg in the Al alloy melt. Be, which may also be contained in the alloy according to the present invention, does not impair its properties.

Next, the steps of the production process applied to the above Al—Mg—Cu(—Mn/Zr/Cr) alloy according to the present invention are described.

First, an ingot having the composition as described above is homogenized at a temperature in the range of 450° to 560° C. for 1 to 48 hours, thereby enhancing the formability and refining the recrystallized grains. When the homogenizing temperature is less than 450° C., and the homogenizing time is less than 1 hour, the formability is not enhanced and the recrystallized grains are not refined. When the homogenizing temperature exceeds 560° C., melting may occur at the eutectic. A homogenizing time exceeding 48 hours is not economic.

After the homogenizing, hot rolling is carried out by a conventional method, and cold rolling is then carried out, if necessary, to obtain the required sheet thickness.

The solid solution treatment is carried out at a temperature in the range of from 350° to 560° C., preferably from 460° to 560° C., followed by quenching at a cooling rate of 300° C./min or more, preferably 1000° C./min or more. This treatment is intended to dissolve the Al—Mg—Cu phase (S phase) which contributes to strengthening of the sheet, thereby enhancing the strength and elongation properties and preventing decreasing of strength after paint baking. This enhancement is not achieved when the temperature of the solid solution treatment is lower than 350° C. On the other hand, when the temperature of solid solution treatment is higher than 560° C., eutectic melting may occur. The precipitation of the S phase is small in amount in the alloy composition of the present invention. The holding time at the solution temperature is therefore not limited at all, but is preferably 5 minutes or less from the economic viewpoint. The cooling rate of 300° C./min or more is necessary for suppressing the precipitation of the S phase and other secondary phases during quenching. This cooling rate can be obtained for instance by forced air cooling or water cooling. The forced air cooling is preferred since the distortion due to quenching can be reduced to as low a level as possible.

The sheet with T4 temper as described above exhibits improved properties. However, the thermal stress generated by the quenching may occasionally lead to warp, bending, twist, wave, and the like (hereinafter referred to as the "distortion"). When the distortion exceeds a limit, not only is the formability detrimentally influenced but also flaws are formed during handling.

Next, the process including the final heat treatment after straightening is described in detail.

The straightening is carried out at a degree of work hardening during the straightening dependent upon the degree of distortion after quenching, but is such that the yield strength is increased by 1 $kgf/mm^2$ or more and the formability is impaired in terms of Erichsen values by 0.2 mm or more.

The rolled sheet which has been subjected to flattening (process) and exhibits a reduced formability is subjected to the final heat treatment, in which the sheet is heated to a temperature of from 60° to 360° C., held at this temperature, then cooled, or heated to the above temperature followed by immediate cooling.

Referring to FIG. 1, the hatched region, i.e., the straight lines or curve connecting the points A, B, C, D, E and F are region surrounded thereby, determines, when the heating temperature is given on an abscissa, that the heating rate on the ordinate is such that the crossing point of the ordinate and abscissa values falls within the hatched region.

Figure 2:
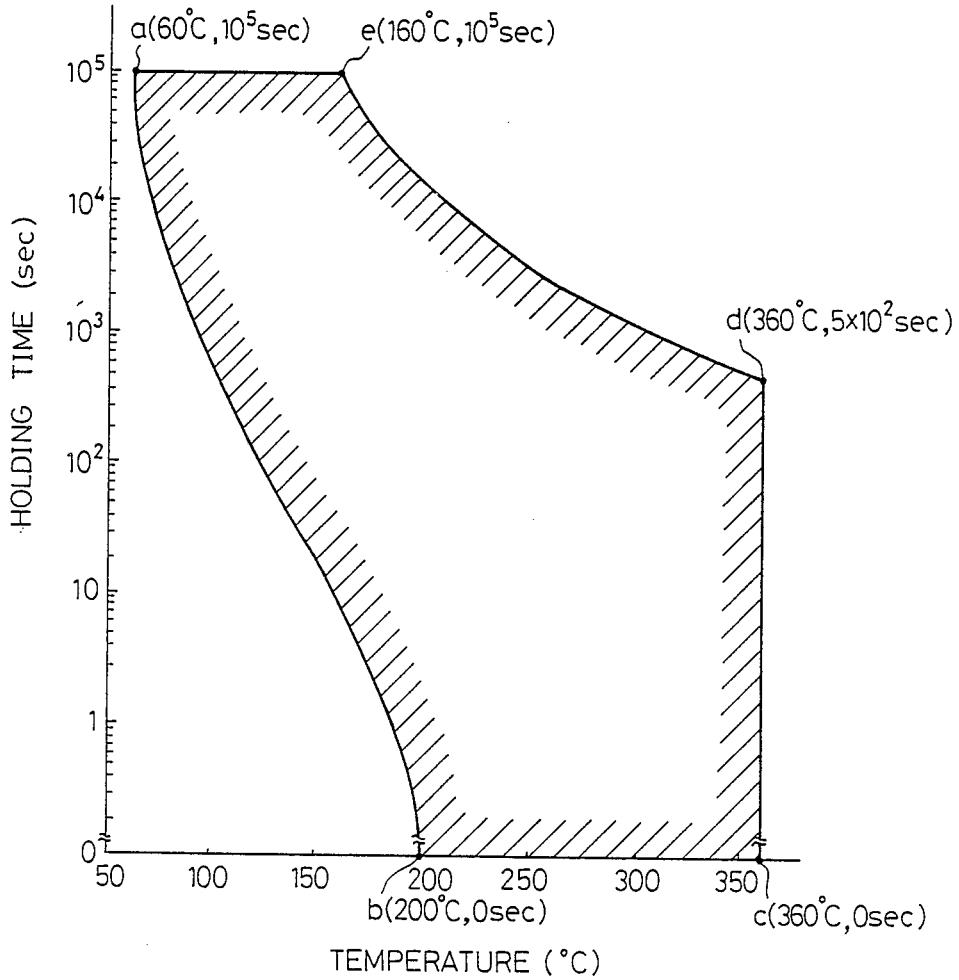
FIG. 2 is a graph showing the appropriate range of the holding time and temperature.

Referring to FIG. 2, the hatched region, i.e., the straight lines or curve connecting the points a, b, c, d and e and the region surrounded thereby, determines, when the heating temperature is given on an abscissa, that the holding time on the ordinate is such that the crossing point of the ordinate and abscissa values falls within the hatched region.

The cooling rate is determined within the hatched region of FIG. 1.

The points A through F in FIG. 1 indicate the following temperatures and heating or cooling speeds.

A: 60° C., $4\times10^{3°}$ C./sec
B: 60° C., $4\times10^{-3°}$ C./sec
C: 200° C., $4\times10^{-3°}$ C./sec
D: 360° C., $2\times10^{-3°}$ C./sec
E: 360° C., $3\times10^{3°}$ C./sec
F: 230° C., $4\times10^{3°}$ C./sec The points a through e in FIG. 2 indicate the following temperatures and holding times.

a: 60° C., $10^5$ sec
b: 200° C., 0 sec
c: 360° C., 0 sec
d: 360° C., $5\times10^2$ sec
e: 160° C., $10^5$ sec In the Al—Mg—Cu series aluminum alloy according to the present invention, although the work hardening may be relieved, the precipitation of the $\beta$ phase ($Mg_2Al_3$ phase) and Cu series S phase may occur during the heating, holding, and cooling of the final heat treatment. When these precipitates are coarsely precipitated along the grain boundaries, the formability, particularly the bending and elongation properties, is reduced. Accordingly, it is necessary to relieve the work hardening in the final heat treatment while avoiding the problems due to precipitation. It is also necessary to maintain the flatness attained by the straightening. Also, the economics of the process must be considered. The respective ranges are determined in the light of the above points.

[Heating Rate]

Below the straight line BC, no problems arise as far as the properties of the material are concerned. But, the slow heating at, on or below the line BC necessitates an extremely long time for the temperature elevation, which reduces the productivity.

When the heating temperature and rate are in a region below the line CD, precipitation occurs during the temperature elevation and thus the formability is reduced.

When the heating temperature is higher than 360° C., i.e., to the right from the line DE, the generation of distortion again occurs during the heating or the sheet surface is impaired due to the oxidation of Mg.

When the heating temperature and rate are above the line EF, the heating is very rapid in a high temperature region, causing the generation of distortion and thus losing the straightening effect.

When the heating rate are above the line AF, i.e., $4\times10^{3°}$ C./sec, the heating is more rapid than the heating caused by throwing a sheet into an oil or salt bath having a temperature of from 60° C. to 230° C. In this case, it is difficult to apply such rapid heating to a rolled sheet in the form of a cut sheet or a coil.

When the heating temperature is lower than 60° C., the work hardening due to straightening cannot be relieved.

Based on the above reasons, the range of heating-temperature and speed is in the hatched region surrounded by A, B, C, D, E, and F.

The heating means of a cut sheet used for attaining the heating rate in the range A–F are, for example, a batch furnace (loading the sheet in a furnace at a required temperature or heating the sheet together with temperature-elevation of a furnace), continuous furnace, oil bath, salt bath, and a metal bath. The heating means of a coil is a batch furnace or a continuous furnace.

Holding Temperature and Time

When, upon arrival at the holding temperature of 200° to 360° C., the cooling is immediately initiated with a zero holding time, as illustrated by the line bc, the working strain can be relieved.

When the holding temperature is higher than 360° C., the working strain can be relieved but the sheet surface may be deteriorated due to the oxidation of Mg.

When the holding temperature and time are above and to the right of the curve de, the work hardening can be relieved but the $\beta$ phase and coarse precipitates of Cu or Zn series may be formed to impair the formability, particularly the elongation and bending properties.

When the holding time is above the straight line ae, the working strain can be relieved but the holding time exceeds 24 hours, which is economically disadvantageous.

When the holding time and temperature are below or to the left of the curve ab, the heat necessary for relieving the work hardening is not imparted and an appreciable recovery of the formability is not attained.

Based on the above reasons, the range of holding temperature and time should be in the range surrounded by a, b, c, d, and e.

Cooling Rate

Below the straight line BC, no problems arise as far as the properties of the material are concerned. But the slow cooling on or below the line BC necessitates an extremely long cooling time, which is not economical.

The cooling means of a cut sheet used for attaining the cooling rate is the range of A, B, C, D, E, and F are, for example, furnace cooling, cooling in still air, forced air-cooling, water-cooling and cooling with mist.

Such cooling means of a coil is, for example, furnace cooling in a batch furnace or cooling outside a batch furnace or forced air or spray water or mist cooling in a continuous furnace.

When the cooling temperature and rate are in a region below the line CD, coarse precipitates are formed during the cooling and thus the formability is reduced. Since the heating at a temperature higher than 360° C., i.e., to the right from the line DE, is not carried out according to the present invention, the cooling in this region cannot be carried out.

When the cooling temperature and rate are above the line EF, the cooling rate is very rapid in a high temperature region, which causes also distortion due to thermal stress and thus a loss of the effects of straightening prior to the final heat treatment.

When the cooling rate is above the line AF, i.e., $4\times10^{3°}$ C./sec, the cooling rate is more rapid than water cooling. In this case, it is difficult to apply such a rapid cooling to a rolled sheet in the form of a cut sheet or a coil.

Since the heating at a temperature lower than 60° C. is not carried out, the cooling in the region to the left of the straight line cannot be carried out.

Base on the above reasons, the range of cooling-temperature and rate in the hatched region surrounded by A, B, C, D, E, and F.

When the final heat treatment is carried out after the flattening step, the work hardening induced in this step is relieved to restore the formability, particularly the bulging-formability, and an excellent formability, particularly bulging-formability attained in a T4 tempering after the solid solution and quenching treatment, can be fully stored.

In addition, since coarse precipitates are not formed during the heat treatment, the formability is not reduced thereby, and in addition, distortion is not generated and the improved flatness obtained by the preceding straightening is maintained during the heat treatment.

The aluminum alloy rolled sheet is ordinarily subjected to forming, such as press forming, when applied for practical use. Since the aluminum alloy rolled sheet according to the present invention has an improved formability and exhibits no generation of Leuders marks, there is little possibility of generating defective individuals, and thus the recovery rate and good productivity are obtained.

The present invention is hereinafter described with reference to the examples.

EXAMPLE 1

Alloys having a composition as shown in Table 1 were continuously cast, homogenized at 530° C. for 10 hours, then hot rolled to a sheet thickness of 4 mm and further cold rolled to a sheet thickness of 1 mm.

The forced cooling in marks A and B of Table 2 is at a cooling rate of approximately 1800° C./min within the inventive range.

TABLE 1

| | Composition of Tested Samples | | | | | | | | | |
|---|---|---|---|---|---|---|---|---|---|---|
| Alloy No. | Si (wt %) | Mg (wt %) | Cu (wt %) | Fe (wt %) | Mn (wt %) | Zr (wt %) | Cr (wt %) | Ti (wt %) | B (ppm) | Remarks |
| 0 | 0.14 | 4.43 | 0.48 | 0.21 | — | — | — | 0.01 | 3 | Inventive alloy |
| 1 | 0.15 | 4.48 | 0.56 | 0.23 | 0.35 | — | — | 0.02 | 5 | Inventive alloy |
| 2 | 0.16 | 3.22 | 1.00 | 0.25 | 0.05 | 0.11 | — | 0.02 | 5 | Inventive alloy |
| 3 | 0.09 | 4.50 | 0.31 | 0.17 | 0.07 | — | 0.10 | — | — | Inventive alloy |
| 4 | 0.09 | 4.53 | 0.03 | 0.21 | 0.35 | — | — | 0.02 | 5 | Comparative alloy (equivalent to AA5182) |
| 5 | 0.30 | 0.35 | 2.31 | 0.20 | 0.24 | — | — | 0.02 | 5 | Comparative alloy (equivalent to AA2036) |
| 6 | 0.86 | 0.85 | 0.29 | 0.20 | 0.24 | — | — | 0.03 | 2 | Comparative alloy (equivalent to AA6010) |
| 7 | 0.17 | 3.51 | 1.75 | 0.25 | 0.32 | — | — | 0.02 | 4 | Comparative alloy |

The final heat treatment was then carried out under the various conditions shown in Table 2.

TABLE 2

| | Conditions of Heat Treatment | |
|---|---|---|
| Marks of Heat Treatment | Heat Treatment | Remarks (temper) |
| A | 530° C. × 10 sec → Forced air cooling | T4: Inventive process |
| B | 530° C. × 60 sec → Forced air cooling | T4: Inventive process |
| C | 350° C. × 2 hrs → Slow cooling | O: Comparative process |
| D | 405° C. × 2 hrs → Slow cooling | O: Comparative process |
| E | 530° C. × 1 hr → Water quenching | T4: For 2036 alloy |
| F | 500° C. × 1 hr → Water quenching | T4: For 6010 alloy |

After the final heat treatment, the aging was carried out at normal temperature for two weeks. The mechanical properties and formability were then investigated. The results are shown in Table 3.

TABLE 3

| | | | Mechanical Properties and Formability | | | | | | |
|---|---|---|---|---|---|---|---|---|---|
| Alloy No. | Marks of Heat Treatment | Temper | Yield Strength kg/mm$^2$ | Tensile Strength kg/mm$^2$ | Elongation % | Erichsen Value | LDR | Bending mm | Generation of Luder's Marks |
| 0 | A | T4 | 15.8 | 31.8 | 30 | 9.4 | 2.18 | 0.50 | none |
| 0 | B | T4 | 15.9 | 31.6 | 30 | 9.4 | 2.19 | 0.50 | none |
| 0 | D | O | 14.0 | 28.1 | 24 | 8.8 | 2.07 | 0.70 | none |
| 1 | A | T4 | 16.4 | 32.4 | 29 | 9.3 | 2.17 | 0.50 | none |
| 1 | B | T4 | 16.5 | 32.0 | 29 | 9.3 | 2.18 | 0.50 | none |
| 1 | D | O | 14.3 | 28.6 | 25 | 8.9 | 2.08 | 0.70 | none |
| 2 | A | T4 | 16.6 | 31.5 | 30 | 9.3 | 2.17 | 0.50 | none |
| 2 | B | T4 | 16.6 | 31.6 | 30 | 9.3 | 2.17 | 0.50 | none |
| 2 | D | O | 12.1 | 25.3 | 24 | 8.0 | 2.10 | 0.70 | none |
| 3 | A | T4 | 15.3 | 30.9 | 32 | 9.4 | 2.19 | 0.50 | none |
| 3 | D | O | 14.1 | 28.2 | 24 | 8.7 | 2.06 | 0.75 | none |
| 4 | C | O | 14.5 | 29.8 | 28 | 9.5 | 2.19 | 0.50 | yes |
| 5 | F | T4 | 18.6 | 33.3 | 25 | 8.7 | 2.11 | 1.0 | none |
| 6 | E | T4 | 16.0 | 31.3 | 27 | 9.0 | 2.17 | 0.70 | none |
| 7 | A | T4 | 19.2 | 34.6 | 26 | 8.6 | 2.10 | 0.70 | none |

In Table 3, the bending (mm) indicates the minimum bending radius by 180° bending and LDR indicates the limiting drawing ratio.

As is apparent from Table 3, Alloy Nos. 0, 1 and 2, which have a composition within the inventive range and which are solid solution treated and then quenched within the range of the inventive processing condition to provide the T4 temper, exhibit bulging and bending properties equivalent to the 5182 alloy with 0 temper (No. 4) and an improved strength and have no Lüder's marks. It is therefore understood that an Al alloy rolled sheet according to the present invention is appropriate for parts subjected to the heavy working of forming and required to have a high strength, such as a body sheet, an air cleaner, or an oil tank.

EXAMPLE 2

The alloys shown in Table 1 were treated by the same method as in Example 1 and then worked at various working degrees (0%, 5%, and 10%) and baked at 175° C. for 1 hour. The yield strength was measured under the worked condition and after baking to determine the decrease in yield strength by the working-baking. The results are shown in Table 4.

TABLE 4

Influence of Working and Baking (yield strengths all in kg/mm²)

| Alloy No. | Marks of Heat Treatment | Yield Strength before Working | Yield Strength After Working | | Yield Strength after Baking | | | Remarks |
|---|---|---|---|---|---|---|---|---|
| | | | 5% working | 10% working | 0% working | 5% working | 10% working | |
| 0 | A | 15.8 | 24.1 | 29.1 | 16.6 | 22.8 | 26.4 | Inventive alloy |
| 0 | D | 14.3 | 20.6 | 26.7 | 14.3 | 16.7 | 18.9 | Inventive alloy Comparative step |
| 1 | A | 16.4 | 26.5 | 31.1 | 17.1 | 24.5 | 27.3 | Inventive alloy |
| 2 | A | 16.6 | 24.2 | 29.6 | 17.8 | 23.1 | 27.6 | Inventive alloy |
| 3 | A | 15.3 | 24.0 | 29.3 | 16.3 | 23.0 | 26.8 | Inventive alloy |
| 4 | C | 14.5 | 20.9 | 27.0 | 14.4 | 16.9 | 19.1 | Comparative alloy |
| 5 | F | 18.6 | 28.2 | 33.5 | 15.0 | 23.5 | 27.0 | Comparative alloy |
| 6 | E | 16.0 | 22.8 | 26.2 | 18.7 | 26.1 | 28.5 | Comparative alloy |
| 7 | A | 19.2 | 27.8 | 33.0 | 19.0 | 26.3 | 29.7 | Comparative alloy |

As apparent from Table 4, the decrease in yield strength due to working-baking of the alloys according to the present invention is outstandingly lower than that of the 5182 alloy (No. 4, Al-Mg series alloy). As is also apparent from Table 4, in the inventive alloys, the baking leads to an increase in the yield strength in the case of no post-cold working and a decrease in the yield strength in the case of post-cold working, which is however smaller than the yield strength-decrease of 5182 alloy. Accordingly, the alloy according to the present invention is very appropriate for use as the material of an automotive body sheet.

EXAMPLE 3

The Al—Mg series Alloy Nos. 1 and 2 shown in Table 5 were melted according to the ordinary method. The ingots, 400 mm×1000 mm×3000 mm in size, were obtained by DC casting. These ingots were subjected to homogenizing at a temperature of 530° C. for 10 hours, followed by hot rolling to a thickness of 4 mm, and further cold rolling to a thickness of 1 mm. The obtained rolled sheets were subjected to continuous recrystallization, solid solution, and quenching treatments in a continuous annealing furnace. In the treatments, the heating rate was 25° C./sec, the heating temperature was 500° C., the holding time was zero second, and the cooling rate was 25° C./sec. After the treatments, the sheets were passed through the tension levelling line to straighten the distortion of the sheets generated by the treatments. In the tension levelling line, the sheets are continuously bent and unbent while passing through rolls, with applying the tension to the sheets. The deformation imparted to the sheets by the tension levelling corresponds to a cold working degree of a few percent of cold reduction. The straightened and then cut sheets of 1000×2000 mm in size were subjected to the final heat treatment under the conditions given in Table 6.

Table 7 shows the tensile strength $\sigma_B$, the 0.2% yield strength $\delta_{0.2}$, elongation $\delta$, and the Erichsen value determined at the respective steps after the quenching, straightening and final heat treatments. The distortion of the sheets under the final heat treatment condition was observed with the naked eye and is also shown in Table 7. The appreciable distortion is indicated by an x symbol, and nonappreciable distortion is indicated by an o mark.

TABLE 5

Chemical Composition of Tested Alloys

| Alloy Nos. | Cu | Si | Fe | Mn | Mg | Zn | Cr | Ti | Zr | V | Al |
|---|---|---|---|---|---|---|---|---|---|---|---|
| 1 | 0.70 | 0.15 | 0.23 | Tr | 3.61 | Tr | Tr | 0.01 | Tr | Tr | bal |
| 2 | 0.24 | 0.10 | 0.23 | 0.21 | 4.50 | 0.01 | Tr | 0.01 | Tr | Tr | bal |

TABLE 6

Conditions for Final Heat Treatment

| Symbol for Conditions | Alloy Nos. | Designation | Heating Rate (°C./sec) | Temperature (°C.) | Holding Time (sec) | Cooling Rate (°C./sec) | Heating Means | Cooling Means |
|---|---|---|---|---|---|---|---|---|
| A | 1 | Inventive | $8 \times 10^{-3}$ | 100 | 7200 | $1.5 \times 10^{-2}$ | Batch furnace (Temperature elevation after | Furance cooling |

TABLE 6-continued

| Symbol for Conditions | Alloy Nos. | Designation | Conditions for Final Heat Treatment: Heating Rate (°C./sec) | Temperature (°C.) | Holding Time (sec) | Cooling Rate (°C./sec) | Heating Means | Cooling Means |
|---|---|---|---|---|---|---|---|---|
| | | | | | | | loading) | |
| B | 1 | Inventive | 20 | 300 | 0 | 20 | Oil bath | Forced air cooling |
| C | 2 | Inventive | $5.5 \times 10^{-3}$ | 140 | 7200 | $5.5 \times 10^{-3}$ | Same as A | Furnace cooling |
| D | 1 | Comparative | $8 \times 10^{-3}$ | 250 | 0 | $10^3$ | Same as A | Water cooling |
| E | 1 | Comparative | 2 | 100 | 50 | $10^3$ | Batch furnace (Loading the sheet in a furnace at a required temperature) | Water cooling |
| F | 1 | Comparative | 20 | 250 | 7200 | $10^3$ | Oil bath | Water cooling |
| G | 1 | Comparative | 2 | 250 | 20 | $5 \times 10^3$ | Same as E | Furnace cooling |
| H | 1 | Comparative | 20 | 350 | 0 | $10^3$ | Oil bath | Water cooling |

TABLE 7

| Symbol for Conditions | Alloy Nos. | Designation | Before Levelling: $\sigma_B$ kg/mm² | $\sigma_{0.2}$ kg/mm² | δ % | Er mm | After Levelling: $\sigma_B$ kg/mm² | $\sigma_{0.2}$ kg/mm² | δ % | Er mm | After Final Heat Treatment: $\sigma_B$ kg/mm² | $\sigma_{0.2}$ kg/mm² | δ % | Er mm | Deformation of Final Sheet |
|---|---|---|---|---|---|---|---|---|---|---|---|---|---|---|---|
| A | 1 | Inventive | 29.6 | 14.3 | 30 | 9.9 | 30.8 | 15.8 | 27 | 8.9 | 30.2 | 14.9 | 31 | 9.8 | o |
| B | 1 | Inventive | 31.7 | 17.3 | 33 | 10.2 | 33.1 | 19.6 | 27 | 9.3 | 31.8 | 17.3 | 33 | 10.2 | o |
| C | 2 | Inventive | 27.8 | 12.3 | 32 | 10.2 | 28.1 | 13.3 | 29 | 9.6 | 28.3 | 13.2 | 32 | 10.1 | o |
| D | 1 | Comparative | 29.6 | 14.3 | 30 | 9.9 | 30.8 | 15.8 | 27 | 8.9 | 29.4 | 14.0 | 25 | 8.7 | o |
| E | 1 | Comparative | 29.6 | 14.3 | 30 | 9.9 | 30.8 | 15.8 | 27 | 8.9 | 30.8 | 15.7 | 27 | 8.9 | o |
| F | 1 | Comparative | 29.6 | 14.3 | 30 | 9.9 | 30.8 | 15.8 | 27 | 8.9 | 29.3 | 13.8 | 25 | 8.6 | o |
| G | 1 | Comparative | 29.6 | 14.3 | 30 | 9.9 | 30.8 | 15.8 | 27 | 8.9 | 29.5 | 14.1 | 26 | 8.8 | o |
| H | 1 | Comparative | 29.6 | 14.3 | 30 | 9.9 | 30.8 | 15.8 | 27 | 8.9 | 29.8 | 14.2 | 31 | 9.8 | x |

As is apparent from Table 7, in all of Conditions A through H, the elongation δ and the Erichsen value after levelling are lower than those before levelling, and therefore, the formability is reduced. In the case of Conditions A through C, in which the final heat treatment was carried out within the range of the present invention, the elongation and the Erichsen value under the finally heat treated condition are virtually the same as those under the T4 tempering before the levelling. This indicates that the formability was satisfactorily restored by the final heat treatment. A deformation such that it would impair the flatness of the sheets was not generated under the inventive conditions A through C.

The condition D is an example of a too slow heating; the condition E is an example of a too short holding time at the holding temperature; the condition F is an example of a too long holding time; and the condition G is an example of a too slow cooling at the final heat treatment. In these cases, the formability was not restored to that before levelling, or the formability was reduced to some extent. In addition, Condition H is an example of a too fast cooling in the final heat treatment. In this case, the formability was restored but the rolled sheet was deformed, degrading the flatness. Accordingly, it is apparent that, to restore the formability to that attained by the T4 tempering and to maintain the flatness attained by the levelling, the conditions of the final heat treatment must fall within the range of present invention.

Since the quenching (rapid cooling) is not carried out under Condition C of Table 6, the distortion of a sheet does not occur and the levelling is therefore unnecessary. But the formability is inferior to that of the material having T4 temper with rapid heating and cooling.

The aluminum alloy rolled sheet according to the present invention is most appropriate for application for the automobile body, and can also exhibit excellent characteristics when used for automobile parts, such as an air cleaner, and for various instruments for home use.

We claim:

1. A heat treated aluminum alloy rolled sheet for forming, which has a T4 temper and does not exhibit Lüder's marks during forming, and which consists, by percentage weight, of from 1.5 to 5.5% of Mg, from 0.18 to 1.5% of Cu, the balance being aluminum and unavoidable impurities including from 0.05 to 0.4% of Fe and from 0.05 to 0.4% of Si.

2. A heat treated aluminum alloy rolled sheet according to claim 1, produced by the process comprising the steps of: homogenizing an ingot at a temperature of from 450° to 560° C.; rolling to a required thickness; and subsequently solid solution treating at a temperature of from 350° to 560° C. followed by rapid cooling at a cooling rate of 300° C./min or more.

3. A heat treated aluminum alloy rolled sheet according to claim 2, wherein the solid solution treating temperature is from 460° to 560° C.

4. A heat treated aluminum alloy rolled sheet according to claim 2 or 3, wherein the cooling rate of rapid cooling is 1000° C./min or more.

5. A heat treated aluminum alloy rolled sheet for forming, which has a T4 temper and which does not exhibit Lüder's marks during forming, and which consists, by percentage weight, of from 1.5 to 5.5% of Mg, from 0.18 to 1.5 of Cu, and at least one element selected from the group consisting of from 0.05 to 0.06% of Mn, from 0.05 to 0.3% of Zr, and 0.05 to 0.3% of Cr, the balance being aluminum and unavoidable impurities including from 0.05 to o.4% of Fe and from 0.05 to 0.4% of Si.

6. A heat treated aluminum alloy rolled sheet according to claim 5, produced by the process comprising the steps of: homogenizing an ingot at a temperature of from 450° to 560° C.; rolling to a required thickness; and subsequently solid solution treating at a temperature of from 350° to 560° C. followed by rapid cooling at a cooling rate of 300° C./min or more.

7. A heat treated aluminum alloy rolled sheet according to claim 6, wherein the solid solution treating temperature is from 460° to 560° C.

8. A heat treated aluminum alloy rolled sheet according to claim 6 or 7, wherein the cooling rate of rapid cooling is 1000° C./min or more.

9. A heat treated aluminum alloy rolled sheet for forming, which has a T4 temper and which does not exhibit Lüder's marks during forming, and which consists essentially, by percentage weight, of from 1.5 to 5.5% of Mg, from 0.8 to 1.5% of Cu, the balance being aluminum and unavoidable impurities including from 0.05 to 0.4% of Fe and from 0.05 to 0.4% of Si, produced by the process comprising the steps of:

homogenizing an ingot at a temperature of from 450° to 560° C.; rolling to a required thickness; and subsequently solid solution treating at a temperature of from 350° to 560° C. followed by rapid cooling rate of 300° C./min or more, and said rapidly cooled aluminum alloy is subjected to straightening, and then heating to a temperature in the range of from 60° to 360° C. at a heating rate falling within the hatched region of FIG. 1, then holding within the hatched region of FIG. 2, and subsequently cooling at a cooling rate falling within the hatched region of FIG. 1.

10. A heat-treated aluminum alloy rolled sheet according to claim 9, further comprising at least one element selected from the group consisting of from 0.05 to 0.6% of Mn, from 0.05 to 0.3% of Zr, and 0.05 to 0.3% of Cr.

11. A process for producing a heat treated aluminum alloy rolled sheet for forming, which does not exhibit the formation of Lüder's marks, comprising the steps of: providing an ingot which consists, by percentage weight, of from 1.5 to 5.5% of Mg, from 0.18 to 1.5% of Cu, the balance being aluminum and unavoidable impurities including from 0.05 to 0.4% of Fe and 0.05 to 0.4% of Si; homogenizing the ingot at a temperature of from 450° to 560° C.; rolling to a required thickness; and subsequently solid solution treating at a temperature of from 350° to 560° C., followed by rapid cooling at a cooling rate of 300° C./min or more.

12. A process according to claim 11, wherein the solid solution treating temperature is from 460° to 560° C.

13. A process according to claim 11 or 12, wherein the cooling rate of rapid cooling is 1000° C./min or more.

14. A process according to claim 11, wherein said rapidly cooled aluminum alloy is subjected to straightening, and then heating to a temperature in the range of from 60° to 360° C. at a heating rate falling within the hatched region of FIG. 1 attached herewith, then holding out within the hatched region of FIG. 2 attached herewith, and subsequently, cooling at a cooling rate falling within the hatched region of FIG. 1.

15. A process for producing a heat treated aluminum alloy rolled sheet for forming, which does not exhibit the formation of Lüder's marks, comprising the steps of: providing an ingot which consists, by percentage weight, of from 1.5 to 5.5% of Mg, from 0.18 to 1.5% of Cu, and at least one element selected from of the group consisting of from 0.05 to 0.6% of Mn, from 0.05 to 0.3% of Zr, and from 0.05 to 0.3% of Cr the balance being aluminum and unavoidable impurities including from 0.05 to 0.4% of Fe and 0.05 to 0.4% of Si; homogenizing the ingot at a temperature of from 450° to 560° C.; rolling to a required thickness; and subsequently solid solution treating at a temperature of from 350° to 560° C., from, followed by rapid cooling at a cooling rate of 300° C./min or more.

16. A process according to claim 15, wherein the solid solution treating temperature is from 460° to 560° C.

17. A process according to claim 15 or 16, wherein the cooling rate of rapid cooling is 1000° C./min or more.

18. A process according to claim 17, wherein said rapidly cooled aluminum alloy is subjected to straightening, and then heating to a temperature in the range of from 60° to 360° C. at a heating rate falling within the hatched region of FIG. 1 attached herewith, then holding within the hatched region of FIG. 2 attached herewith, and subsequently, cooling at a cooling rate falling within the hatched region of FIG. 1.

19. A process for producing a formed product of an aluminum alloy, comprising the steps of: providing an ingot which consists, by percentage weight, of from 1.5 to 5.5% of Mg, from 0.18 to 1.5% of Cu, the balance being aluminum and unavoidable impurities including from 0.05 to 0.4% of Fe and 0.05 to 0.4% of Si; homogenizing said ingot at a temperature of from 450° to 560° C.; rolling to form a sheet having a required thickness; solid solution treating at a temperature of from 350° to 560° C., followed by rapid cooling at a cooling rate of 300° C./min or more; straightening to remove distortion of the sheet generated by the solid solution treating and rapid cooling; forming the sheet into a structural member by such a working degree that Lüder's marks are formed in the case of composition of said aluminum alloy without Cu addition, thereby obtaining a structural member without Lüder's marks, applying a paint on a formed body; and baking the paint while the decrease in yield strength is small.

20. A process according to claim 19, wherein the solid solution treating temperature is from 460° to 560° C.

21. A process according to claim 19 or 20, wherein the cooling rate of rapid cooling is 1000° C./min or more.

22. A process according to claim 19, wherein said straightened aluminum alloy is subjected then to heating to a temperature in the range of from 60° to 360° C. is carried out at a heating rate falling within the hatched region of FIG. 1 attached herewith, then holding is carried out within the hatched region of FIG. 2 attached herewith, and subsequently, cooling is carried out at a cooling rate falling within the hatched region of FIG. 1, so as to restore formability to that before straightening.

23. A process for producing a formed product of an aluminum alloy, comprising the steps of: providing an ingot which consists, by percentage weight, of from 1.5 to 5.5% of Mg, from 0.18 to 1.5% of Cu, and at least one element selected from of the group consisting of from 0.05 to 0.6% of Mn, from 0.05 to 0.3% of Zr, and from 0.05 to 0.3% of Cr, the balance being aluminum and unavoidable impurities including from 0.05 to 0.4% of Fe and 0.05 to 0.4% of Si; homogenizing an ingot having the composition mentioned above at a temperature of from 450° to 560° C.; rolling to form a sheet having a required thickness; solid solution treating at a temperature of from 350° to 560° C., followed by rapid cooling at a cooling rate of 300° C./min or more; straightening to remove distortion of the sheet generated by the solid solution treating and rapid cooling; forming the sheet into a structural member by such a working degree that Lüder's marks are formed in the case of composition of said aluminum alloy without Cu addition, thereby obtaining the structural member without Lüder's marks, applying a paint on a formed body; and baking the paint while decrease in yield strength is small.

24. A process according to claim 23, wherein the solid solution treating temperature is from 460° to 560° C.

25. A process according to claim 23 or 24, wherein the cooling rate of rapid cooling is 1000° C./min or more.

26. A process according to claim 23, wherein said straightened aluminum alloy is subjected then to heating to a temperature in the range of from 60° to 360° C. carried out at a heating rate falling within the hatched region of FIG. 1 attached herewith, then holding within the hatched region of FIG. 2 attached herewith, and subsequently, cooling at a cooling rate falling within the hatched region of FIG. 1, so as to restore formability to that before straightening.

* * * * *

UNITED STATES PATENT AND TRADEMARK OFFICE

CERTIFICATE OF CORRECTION

PATENT NO. : 4,838,958

DATED : June 13, 1989

INVENTOR(S) : Toshio KOMATSUBARA et al

It is certified that error appears in the above-identified patent and that said Letters Patent is hereby corrected as shown below:

Column 13, line 3, "0.06% of Mn" should read -- 0.6% of Mn --.

Signed and Sealed this

Twentieth Day of April, 1993

*Attest:*

MICHAEL K. KIRK

*Attesting Officer*

*Acting Commissioner of Patents and Trademarks*